US008299718B2

(12) United States Patent
Cottrell

(10) Patent No.: US 8,299,718 B2
(45) Date of Patent: Oct. 30, 2012

(54) CONSTANT TEMPERATURE LED DRIVER CIRCUIT

(75) Inventor: Brian Cottrell, Redondo Beach, CA (US)

(73) Assignee: Brian Cottrell, Redondo Beach, CA (US)

( * ) Notice: Subject to any disclaimer, the term of this patent is extended or adjusted under 35 U.S.C. 154(b) by 274 days.

(21) Appl. No.: 12/707,636

(22) Filed: Feb. 17, 2010

(65) Prior Publication Data

US 2011/0199013 A1 Aug. 18, 2011

(51) Int. Cl.
*H05B 37/02* (2006.01)

(52) U.S. Cl. ..... 315/152; 315/150; 315/291; 315/250

(58) Field of Classification Search ..... 315/158, 315/159, 247, 250, 291, 152, 150
See application file for complete search history.

(56) References Cited

U.S. PATENT DOCUMENTS

2007/0057902 A1* 3/2007 Joung ..... 345/102
2009/0079359 A1* 3/2009 Shteynberg et al. ..... 315/291

* cited by examiner

*Primary Examiner* — Douglas W Owens
*Assistant Examiner* — Jonathan Cooper

(57) ABSTRACT

A constant temperature LED driver circuit for controlling the rate of lumen depreciation and therefore useful lifetime of an LED array by keeping the LEDs at a fixed temperature. A temperature sensing means, which measures the temperature of the LEDs, is coupled to a variable power source that drives the LED array. The current provided to the LED array is adjusted in response to the temperature sensing means to ensure that the LEDs remain at a constant temperature regardless of changes in ambient temperature.

2 Claims, 3 Drawing Sheets

CONSTANT TEMPERATURE LED DRIVER CIRCUIT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is directed to an LED (light emitting diode) light source with a driving circuit to drive the LED light source. More particularly the present invention is directed to an LED light source with driving circuitry designed to maintain a constant temperature and therefore a constant useful life for the LED. The luminosity of the LED is adjusted to compensate for fluctuations in ambient temperature in order to prevent excessive depreciation in luminosity over time caused by overheating.

The amount of light produced by an electric light source decreases with time in a process known as lumen depreciation. For an LED, lumen depreciation is primarily caused by heat generated at the LED junction. The useful life of an LED is defined as the total time that the LED can be on before the luminosity decreases by a certain percentage, typically 40 percent. Therefore, the useful life of an LED is primarily temperature dependent.

In order to assign a useful lifetime to a particular LED, a maximum temperature must also be given. For example, an LED may have a lifetime of at least 20,000 hours if kept in an environment that remains below 30 degrees centigrade. This means the useful life may be significantly shorter if the LED is allowed to operate in an environment that regularly exceeds 30 degrees. Also, if kept in much lower temperatures, the LED may have a significantly longer lifetime.

In the prior art, LED circuits are well know with numerous examples and variations disclosed in U.S. Pat. No. 4,675,575. There is also an extensive variety of circuits specifically designed for driving LEDs with various functions and abilities. Several of these are disclosed in U.S. Pat. No. 7,116,294, and include methods for limiting current to the LEDs to prevent overheating. However, along with driving current, ambient temperature also plays an important role in LEDs overheating.

The method of using a temperature sensing means to control the luminous output of an LED is also known, as disclosed in U.S. Pat. Nos. 5,783,909 and 6,127,784. Both patents disclose the use of a temperature sensing means at an LED source to send feedback to a power supply. The average current supplied to the LED source is adjusted to maintain a constant LED luminosity by compensating for changes in luminosity resulting from changes in ambient temperature.

A circuit for maintaining a constant LED current is disclosed in U.S. Pat. No. 7,245,090 as well a method for determining the temperature of an LED based on the amount of current passing through it. However, like the above mentioned patents, the LED driver uses its temperature sensing capabilities to provide a constant luminous output rather than a constant temperature. This is important for many lighting applications where there is a minimum acceptable luminosity. In other applications such as household and decorative lighting, a constant luminosity may be less important than the longevity of the LED.

Therefore it would be desirable to have an LED light source with a driving circuit designed to maximize the useful life of the LED by sacrificing luminosity to compensate for high ambient temperature. Further, it would be desirable to have a LED light source that could reliably be assigned a useful lifetime that is independent of ambient temperature.

BRIEF SUMMARY OF THE INVENTION

The present invention is a Constant Temperature LED Driver Circuit designed to maintain a constant useful lifetime for an LED light source. The invention includes an LED or LED array, a driver circuit, and a temperature sensing means. The driver circuit provides enough current to cause the temperature of the LED array to reach a fixed ideal temperature. If the temperature sensor detects a temperature above the ideal value, the current is reduced. If the temperature drops below the ideal value the current is increased.

Therefore a general object of this invention is to provide an LED light source in which the temperature at the LED junction is held constant regardless of ambient temperature.

Another object of this invention is to maximize the useful lifetime of an LED by sacrificing luminosity in conditions that would otherwise cause an increase in lumen depreciation.

Yet another object of this invention is to provide an LED light source that maximizes luminous output so long as it can do so without sacrificing longevity.

Still another object of this invention is to provide an LED light source with a useful lifetime that can be predicted with reasonable accuracy.

DETAILED DESCRIPTION OF THE INVENTION

Figure 1:
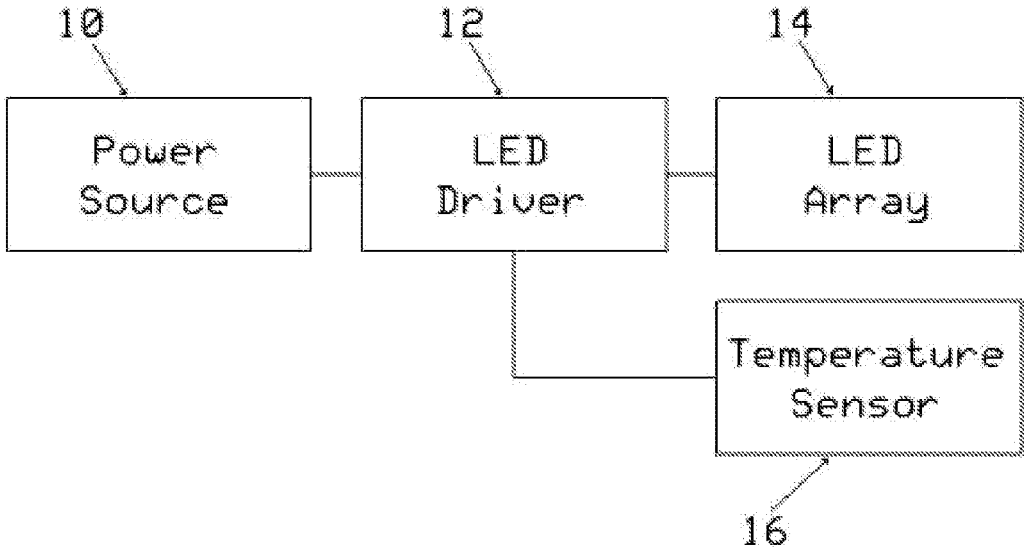
FIG. 1 is a generalized block diagram of a constant temperature LED driver circuit in accordance with certain preferred embodiments of the present invention.

Referring now to the invention in more detail, in FIG. 1 there is shown a simple block diagram for the general layout of the preferred embodiment of a constant temperature LED driver circuit. An AC (alternating current) or DC (direct current) power source 10 powers an LED driver 12, which in turn drives an LED array 14. The LED driver 12 accepts an input signal from a temperature sensing means 16, which measures the temperature of the LED array 14. The LED driver 12 uses this signal to adjust the average current provided to the LED array 14.

Figure 2:
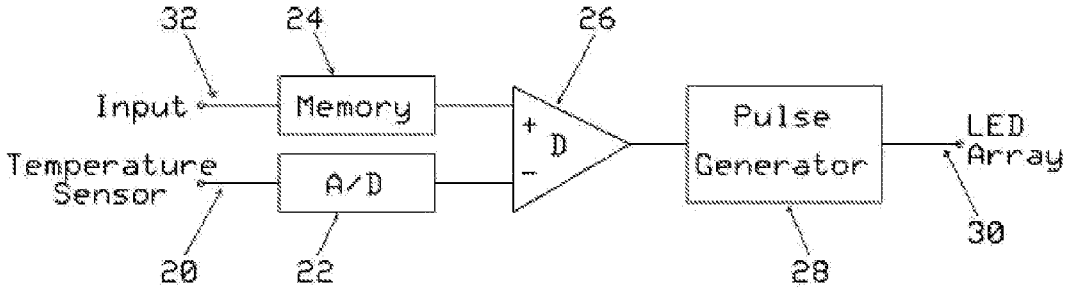
FIG. 2 is a detailed diagram of a LED driver of the constant temperature LED driver circuit of FIG. 1

Referring now to FIG. 2, there is shown a detailed diagram of the LED driver 12 of FIG. 1. The LED driver 12 preferably includes an analog input 20, an analog to digital converter 22, memory storage 24, a digital comparator 26, and pulse generator 28 with a variable pulse width. The output 30 of the pulse generator 28 drives the LED array 14.

As shown in FIG. 2, the analog input 20 is coupled to the output of the temperature sensing means and receives a voltage signal proportional to the temperature of the LED array 14. The voltage signal is then passed through the analog to digital converter 22 to produce a digital temperature value. This measured temperature value is then sent to the comparator 26 and compared to an ideal temperature value that is preprogrammed into the LED driver's 12 memory storage 24. The resulting signal from the comparator 26 is read by the pulse generator 28.

The pulse generator 28 includes programming to increment the width of the output pulse when the comparator 26 signal indicates that the measured temperature is less than the ideal temperature and decrement the width out the output pulse otherwise. The pulse generator 28 operates with a fixed cycle time so the width of each pulse controls the average current to the LED array 14. The cycle time is sufficiently short so that the LED array 14 pulses with a high enough frequency so that it appears to have a continuous luminous output.

Still referring to FIG. 2, the LED Driver 12 may also include a user input 32 allowing the user to access and set the ideal temperature value in the memory storage 24.

Figure 3:
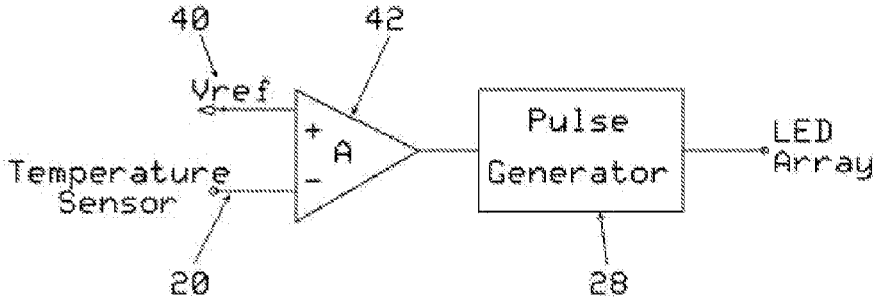
FIG. 3 is an alternate version the LED driver of FIG. 2.

Now referring to FIG. 3, as an alternative to the digital measured temperature and ideal temperature values, the signal to the analog input 20 from the temperature sensing means may be compared directly to a fixed reference voltage 40 using an analog voltage comparator 42. The resulting signal from the analog voltage comparator 42 could then be used by the pulse generator 28 as previously described.

Figure 4:
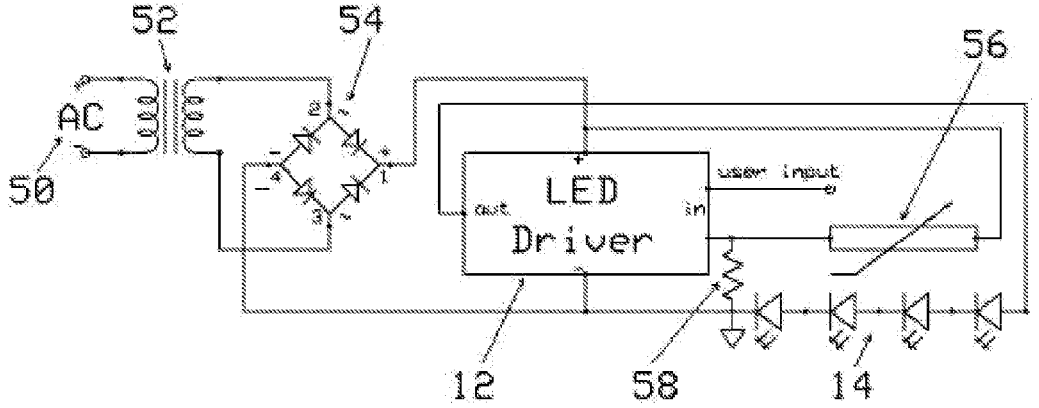
FIG. 4 is a schematic diagram of the electronic circuitry of the preferred embodiment of a constant temperature LED driver circuit.

In FIG. 4 there is shown a schematic diagram of the electronic circuitry of a constant temperature LED driver circuit powered by an AC power source 50. The AC power source 50 is first converted to an appropriate DC source after passing through a transformer 52 and then a rectifier circuit 54. The resulting current is used to power a LED driver 12 that drives an LED array 14. The LED driver 12 receives an input voltage signal from a thermistor 56 placed in contact with or in close proximity to the LED array 14.

The thermistor 56 is coupled to a positive voltage signal a one end and a voltage dividing resistor 58 at the other. The resistor 58 then shares a ground with the LED driver 12. The LED driver 12 reads the voltage drop across the resistor 58, which increases when the temperature of the LED array 14 increases and causes the resistance of the thermistor 56 to drop.

The circuit shown in FIG. 4 may also be powered by a DC power source. In this case, the transformer 52 and rectifier circuit 54 are omitted and replaced with the power source.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A constant temperature LED driver circuit comprising:

a DC(direct current) power source;

an array of one or more LEDs;

a temperature sensing means for sensing the temperature on or around said LED array and producing an electrical temperature signal;

a LED driver electrically connected to said temperature sensing means for supplying a variable average current to said LED array dependant on said temperature signal so that the temperature of said LED array remains constant;

an analog to digital converter coupled to said temperature sensing means for producing a digital measured temperature value;

a means of digitally setting and storing a digital ideal temperature value;

a comparator for comparing said measured temperature value to said ideal temperature value;

an electrical pulse generator coupled to the output of said comparator for driving said LED array wherein the width of the pulse produced by said pulse generator depends on the result of said comparator such that said pulse width is increased whenever said ideal temperature value is greater than said measured temperature value and decreased otherwise.

2. A constant temperature LED driver circuit comprising:

a DC(direct current) power source;

an array of one or more LEDs;

a temperature sensing means for sensing the temperature on or around said LED array and producing an electrical temperature signal;

a LED driver electrically connected to said temperature sensing means for supplying a variable average current to said LED array dependant on said temperature signal so that the temperature of said LED array remains constant;

a means of setting and storing an ideal temperature reference voltage;

an analog comparator for comparing the measured temperature voltage of said temperature sensing means to said reference voltage;

an electrical pulse generator coupled to the output of said comparator for driving said LED array wherein the width of the pulse produced by said pulse generator depends on the result of said comparator such that said pulse width is increased whenever said reference voltage is greater than said measured temperature voltage and decreased otherwise.

* * * * *